United States Patent [19]

Jones

[11] 3,981,533

[45] Sept. 21, 1976

[54] FURNITURE COMBINATION

[76] Inventor: Ferris E. Jones, 943 Millbury Ave., LaPuente, Calif. 91746

[22] Filed: Feb. 3, 1975

[21] Appl. No.: 546,204

Related U.S. Application Data

[63] Continuation-in-part of Ser. No. 488,909, July 16, 1974, which is a continuation of Ser. No. 281,322, Aug. 17, 1972, which is a continuation-in-part of Ser. No. 81,241, Oct. 16, 1970, abandoned.

[52] U.S. Cl. ..... 297/173; 248/398; 297/174

[51] Int. Cl.[2] ..... A47B 39/00

[58] Field of Search ..... 297/172, 173, 140, 141, 297/165, 169, 170, 174, 331; 248/398, 439; 108/50

[56] References Cited

UNITED STATES PATENTS

| | | | |
|---|---|---|---|
| 791,268 | 5/1905 | Jameson | 297/141 X |
| 822,182 | 5/1906 | Cassel | 297/141 |
| 1,026,140 | 5/1912 | Bauer et al. | 297/141 X |
| 1,374,213 | 4/1921 | Marzak | 297/141 |
| 2,321,177 | 6/1943 | Blossom | 297/141 |
| 2,521,160 | 9/1950 | Green | 297/141 |
| 2,845,114 | 7/1958 | Edwards | 297/141 X |
| 3,294,448 | 12/1966 | Palma, Jr. | 297/187 X |

FOREIGN PATENTS OR APPLICATIONS

| | | | |
|---|---|---|---|
| 266,150 | 3/1913 | Germany | 297/141 |

*Primary Examiner*—James T. McCall
*Attorney, Agent, or Firm*—Boniard I. Brown

[57] ABSTRACT

A furniture combination including an article of furniture, such as a seat or table, pivotally attached to a support in a manner such that the article may be elevated above the floor to permit cleaning of the floor area below the article. The article may be retained in elevated position during cleaning by mechanical latch means or by friction or gravity. The furniture support may be another article of furniture, such as a seat, table, or bar.

15 Claims, 27 Drawing Figures

FIG. 11.
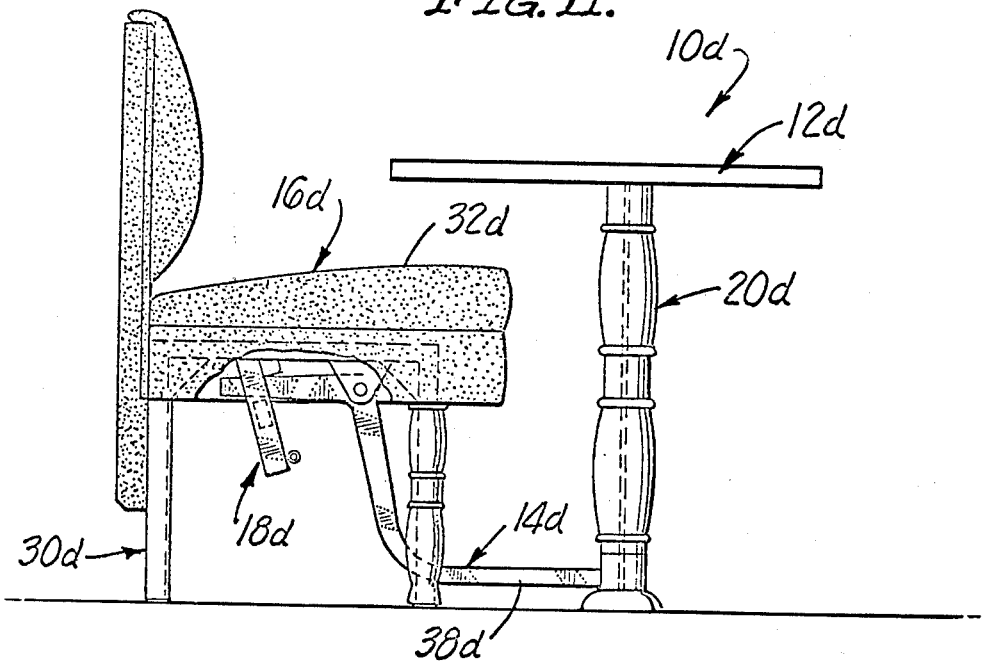
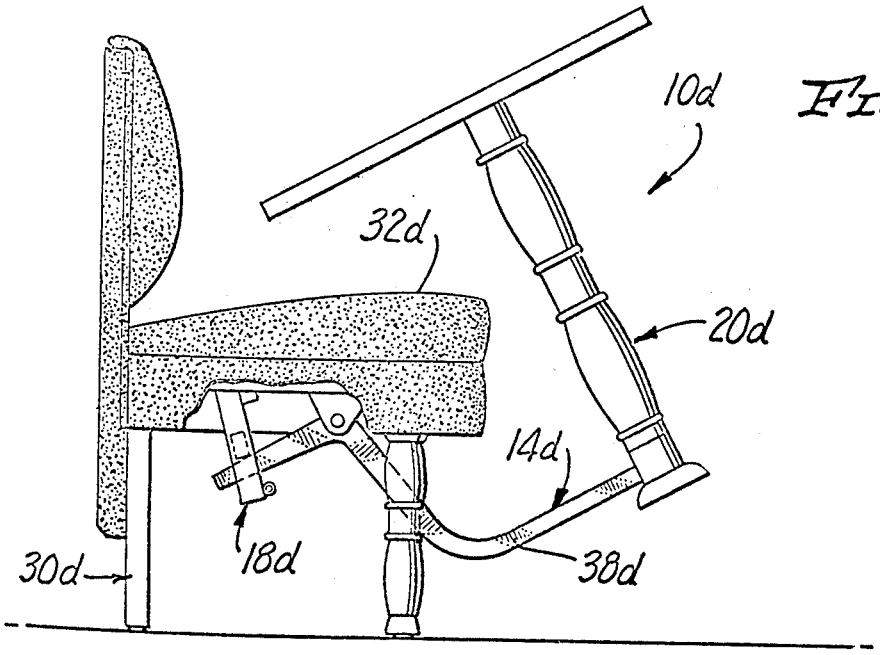
FIG. 12.

FIG. 23.
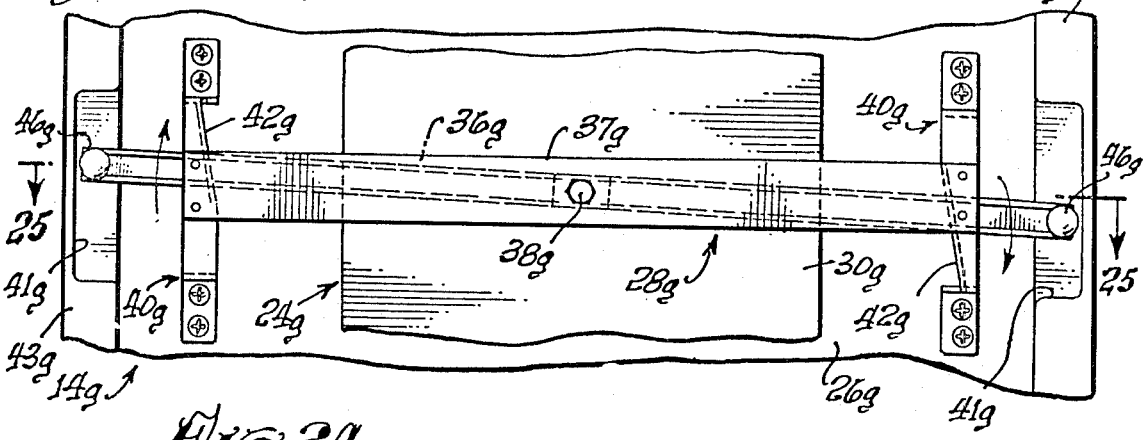
FIG. 24.
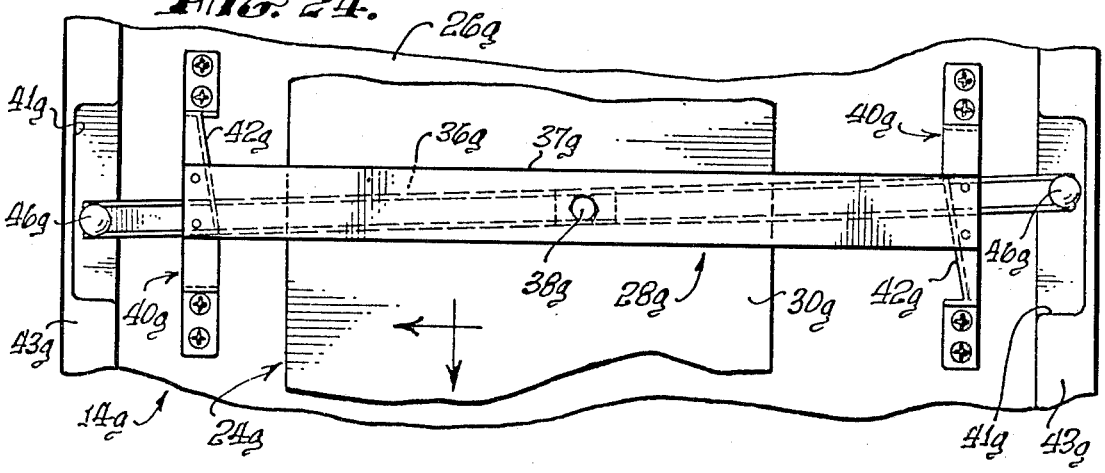
FIG. 25.
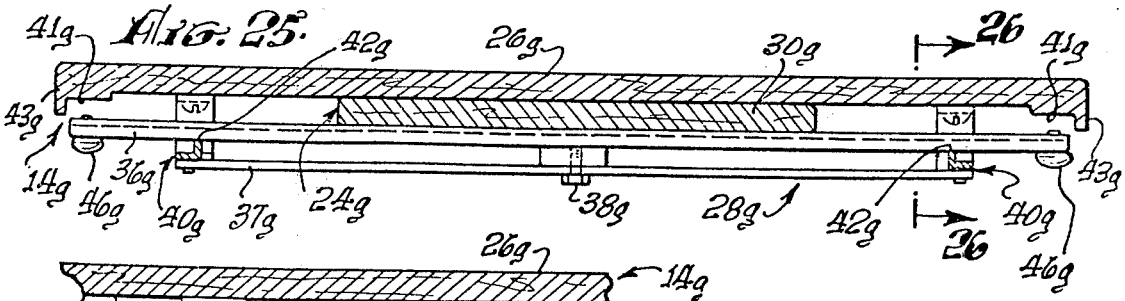
FIG. 26.
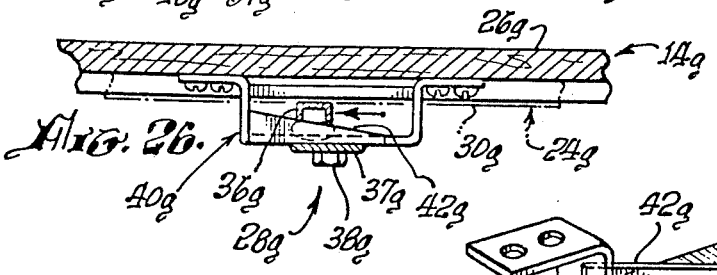
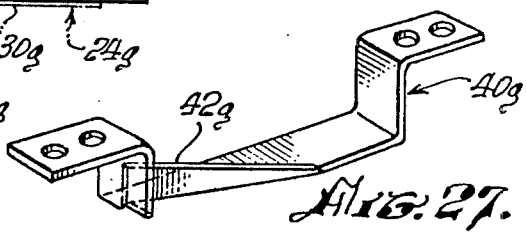
FIG. 27.

FURNITURE COMBINATION

RELATED APPLICATIONS

This application is a continuation-in-part of application Ser. No. 488,909, filed July 16, 1974, which is a continuation of Ser. No. 281,322 filed Aug. 17, 1972, which, in turn, is a continuation-in-part of Ser. No. 81,241, filed Oct. 16, 1970, now abandoned. Reference is also made to co-pending application Ser. No. 549,136, filed Feb. 12, 1975 entitled Table, which is a continuation-in-part of Ser. No. 365,438.

BACKGROUND OF THE INVENTION

1. Field of the Invention

This invention relates generally to furniture and more particularly to a novel furniture combination including an article of furniture hinged to a support in such a way that the article may be raised to and retained in a raised position above the floor to permit cleaning of the floor area below the article.

2. Prior Art

As will appear from the ensuing description, the furniture combination of the invention is capable of both commercial use in restaurants, cafes, cocktail lounges and the like and private use in homes and apartments. However, the furniture combination is intended primarily for use in commercial establishments of the kind mentioned and will be described in relation to such use.

Restaurants, cafes, cocktail lounges and other similar commercial establishments present a floor cleaning problem owing to the large number of seats and tables which are commonly utilized in such places. At the present time, for example, when cleaning the floor of such an establishment, any one of three different procedures may be followed. The tables and seats may be removed in mass from the floor, or the tables and seats may be shifted about on the floor as the latter is cleaned, or the tables and seats may be left in place. The first two procedures obviously present a laborious and time consuming task. The third procedure, while perhaps not as time consuming, renders the cleaning task more tedious and less thorough.

SUMMARY OF THE INVENTION

The present invention provides a unique furniture combination which obviates these disadvantages of the existing furniture. This furniture combination includes an article of furniture, such as a seat or table, a furniture support, and means pivotally mounting the article on the support in a manner which permits the article to be elevated to and retained in a raised position above the floor so as to permit cleaning of the floor area below the article. The furniture support may be another article of furniture, such as a table, seat or bar. In one disclosed embodiment, the furniture article is retained in elevated position by mechanical detent or latch means. In another embodiment, the article is retained in elevated position by friction or gravity by movement of its center of gravity to or past a deadcenter position relative to the pivot axis.

In one disclosed embodiment of the invention, the furniture support is a seat and the article of furniture to be supported is a table, referred to herein as a tilt table. In another embodiment, the support is a table, more precisely, a cocktail bar and the furniture article is a seat, such as a bar stool. In this regard, it is worthy of note at the outset that in the context of the present disclosures, the terms "table", "seat", and "furniture" are used in a broad generic sense to mean any table and seat or table and seat-like articles for either commercial or home use. As noted earlier, however, the present furniture combination is intended primarily for use in restaurants, cafes, cocktail lounges, and other similar commercial establishments.

BRIEF DESCRIPTION OF THE DRAWINGS

FIG. 11 is a side elevation of a further modified furniture combination according to the invention showing the furniture article in its normal lowered position;

FIG. 12 is a view similar to FIG. 11 showing the furniture article fixed in raised position;

FIG. 23 is an enlarged view taken on line 23—23 in FIG. 20 showing the table top locking means in locked position;

FIG. 24 is a view similar to FIG. 23 showing the locking means in unlocked position;

FIG. 25 is a section taken on line 25—25 in FIG. 23;

FIG. 26 is a section taken on line 26—26 in FIG. 25; and

FIG. 27 is an enlarged perspective view of a lock bar camming ramp bracket used in the table of FIG. 20.

DESCRIPTION OF THE PREFERRED EMBODIMENTS

Figure 1:
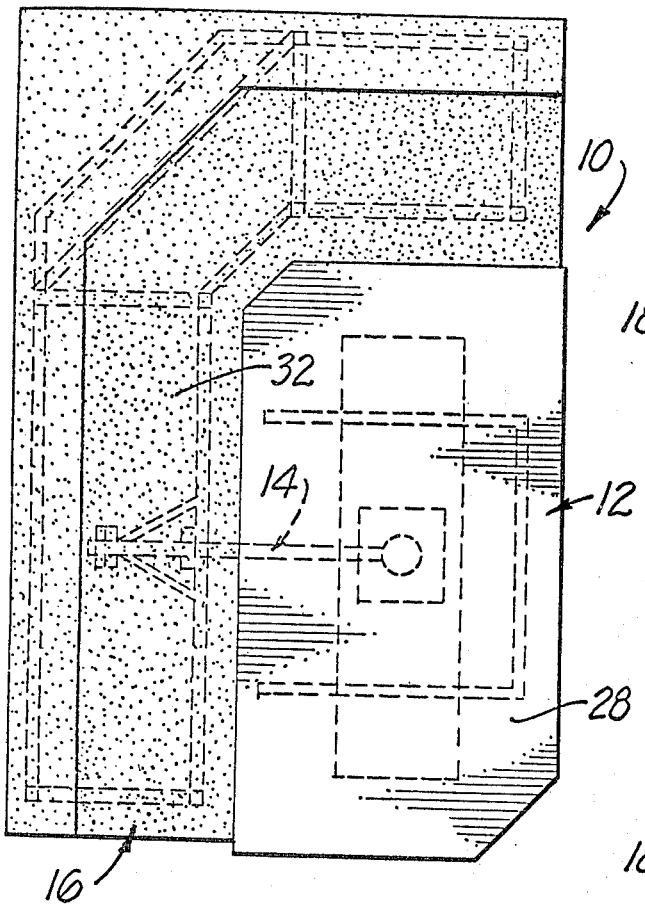
FIG. 1 is a top plan view of a furniture combination according to the invention.
Figure 5:
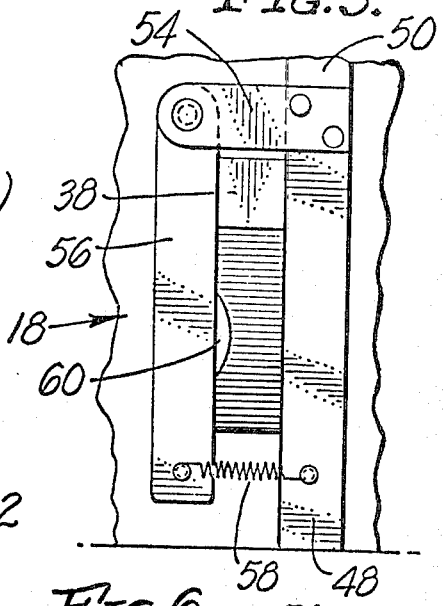
FIG. 5 is an enlarged view looking in the direction of the arrows 5—5 in FIG. 3.
Figure 6:
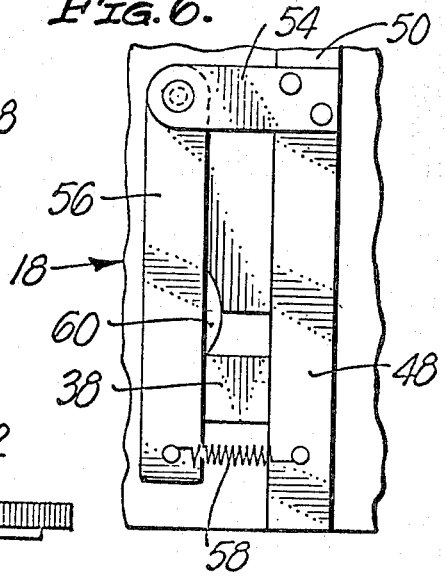
FIG. 6 is an enlarged view looking in the direction of the arrows 6—6 in FIG. 4.
Figure 2:
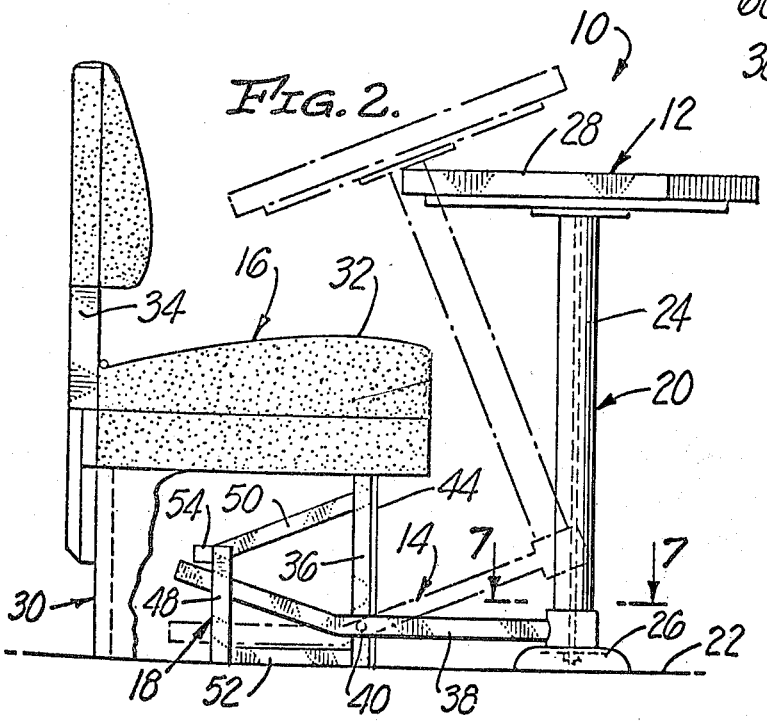
FIG. 2 is a side elevation of the combination.
Figure 7:
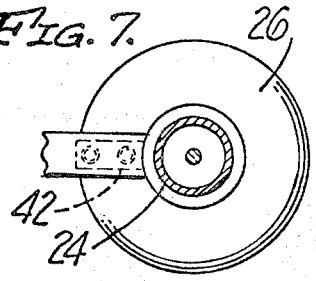
FIG. 7 is an enlarged section taken on line 7—7 in FIG. 2.
Figure 3:
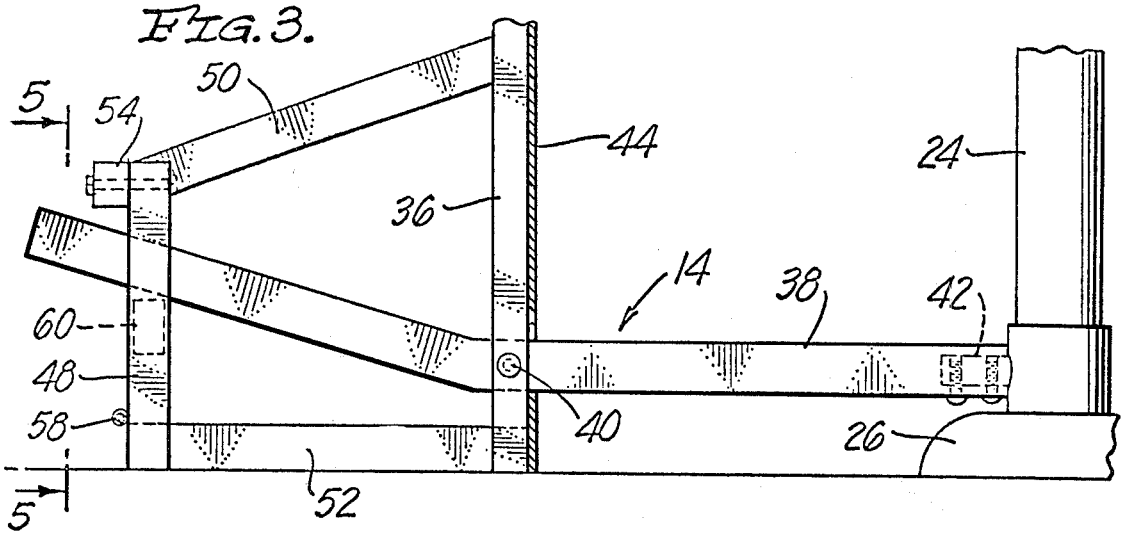
FIG. 3 is an enlarged fragmentary detail of the hinged linkage for joining the article of furniture to its support.
Figure 4:
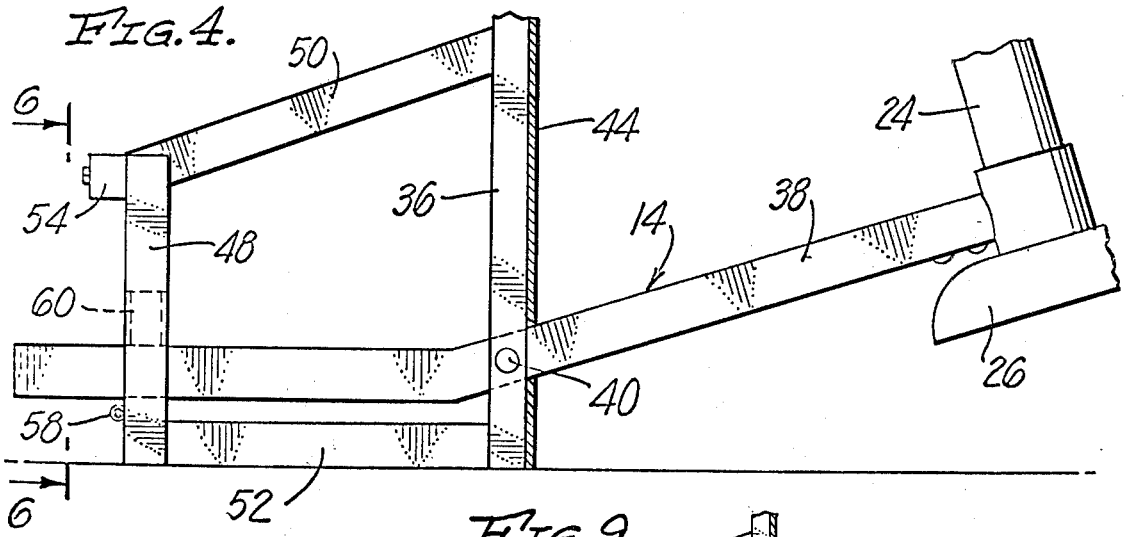
FIG. 4 is a view similar to FIG. 3 showing the furniture article fixed in raised position.

Turning first to FIGS. 1–7, there is illustrated a furniture combination 10 according to the invention including an article of furniture 12 pivotally attached by pivotal mounting means or linkage 14 to a support 16 in such a way that the article may be moved between a normal position of use, shown in solid lines in FIG. 2, and a raised cleaning position, shown in broken lines. Associated with the linkage means 14 are retaining means 18 for releasibly retaining the furniture article in raised position. The article has a supporting base 20 which rests on the floor 22 in the normal position of use of the article. When the article occupies its raised cleaning position, the base is elevated above the floor, as shown, to permit cleaning of the floor below the article.

The particular furniture combination 10 illustrated in a dining nook wherein the furniture article 12 is a tilt table, i.e. a table which may be tilted upwardly to raised position for cleaning the floor, the base 20 of which is a pedestal including a supporting column 24 and a base member 26 at the bottom of the column for resting on the floor. The table top 28 is mounted at the upper end of the column 24 and may be adjustable toward and away from the support 16.

Support 16 is an L-shaped bench seat including a lower supporting base 30, a seat cushion 32 fixed to the top of the base, and a cushioned back rest 34 fixed to the rear side of and rising from the base. Base 30 has front vertical support members or legs 36. When in its lowered position, the table 12 is located in a convenient position of use in front of the seat, as shown.

Figure 8:
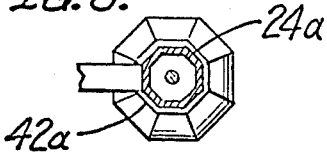
FIG. 8 is an alternate base configuration for the furniture article.
Figure 13:
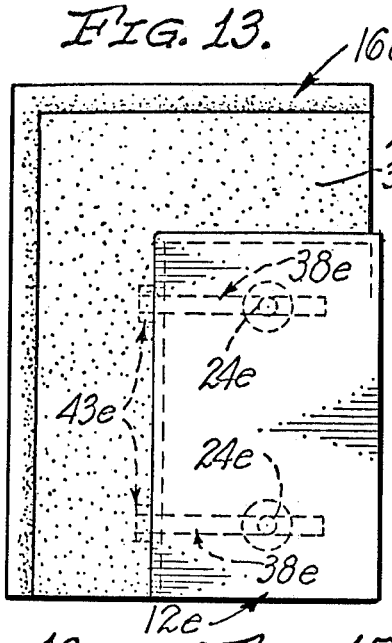
FIG. 13 is a top plan view of a further modified furniture combination according to the invention.

The illustrated linkage means 14 for joining the table 12 and seat 16 includes an arm or lever 38 which is pivoted between its ends at 40 on the front seat support members 36. The outer end of this lever, that is, the right end of the lever in the drawings, is rigidly attached to the table base 20. In FIGS. 1–7, this attachment comprises a tongue 42 on the table base member 26 which is fixed to the outer end of the lever, as shown. FIG. 8 illustrates an alternate attachment in which the outer end of the lever mounts a polygonal sleeve **42*a* receiving the table base column 24*a* which has a polygonal cross section matching the column. The inner end of lever 38 turns up at an oblique angle relative to the outer lever end and projects under the seat cushion 32. Preferably, the front side of the seat base 30 is covered by a decorative facing sheet 44** having an opening through which the lever extends.

The illustrated retaining means 18 comprise yieldable detent means including a vertical bar member 48 rigidly joined by connecting struts 50, 52 to the seat base. Extending laterally from the bar member 48 is a bracket 54 to which is pivotally attached a depending arm 56. A tension spring 58 is connected between the bar member and the lower end of the arm for urging the latter toward the member. Projecting from the inner side of the arm is a rounded detent 60.

The inner or rear end of the furniture support lever 38 projects between the bar 48 and lever 56 such that the latter straddle the lever. When the table 12 occupies its normal position of use, the rear end of lever 38 is located just above the detent 60. Lifting of the table to its raised cleaning position rotates the rear end of lever 38 downwardly between the bar 48 and arm 56 and past the detent, thus camming the arm away from the bar. Spring 58 then returns the arm toward the bar to locate the detent in retaining position above the lever to retain the table 12 in its raised position. In this regard, it will be understood that the spring 58 is sufficiently strong to resist the camming action of the lever 38 against the detent 60 produced by the weight of the table. The table may be returned to its normal position of use by applying an additional downward force on the table.

Figure 9:
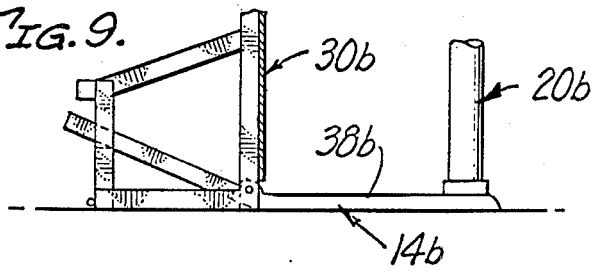
FIG. 9 illustrates a modified linkage arrangement for the furniture combination in FIGS. 1–8.

In the furniture combination described above, the outer or front end of the furniture support lever 38 is spaced a distance from the floor 22 even when the table 12 is lowered to its position of use. FIG. 9 illustrates a modified version of the furniture linkage **14*b* wherein the front end of the support lever 38*b* is attached to the table base 20*b* and to the seat base 30*b*** in such a way that the lever rests on the floor when the table is lowered. This reduces the obstruction presented by the lever to persons' feet.

Figure 10:
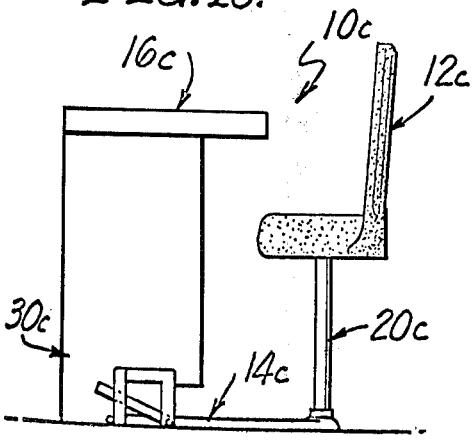
FIG. 10 is a side elevation of a modified furniture combination according to the invention.

Turning now to FIG. 10, there is illustrated a modified furniture combination **10*c* according to the invention in which the article of furniture 12*c* to be raised and lowered is a seat, specifically a bar stool, and the furniture support is a table or more specifically a cocktail bar. The bar stook 12*c* has a pedestal base 20*c* pivotally attached to the base 30*c* of the bar 16*c* by linkage 14*c* like that of FIG. 9. It will be understood, therefore, that the bar stool 12*c*** may be elevated to and releasibly retained in a raised position above the floor to permit cleaning under the stool.

FIGS. 11 and 12 illustrate a further modified furniture combination **10*d* designed for home use. In this case, the article 12*d* to be raised and lowered is a small tilt table of ornamental design and the furniture support 16*d* is a seat or chair. The pedestal base 20*d* of the table is attached to the chair base 30*d* at the underside of the seat cushion 32*d* by a hinged linkage 14*d*. This linkage is similar to those explained above except that the table support lever 38*d* is a bell crank and the detent means 18*d*** are attached to the chair base at the underside of the seat cushion.

Figure 14:
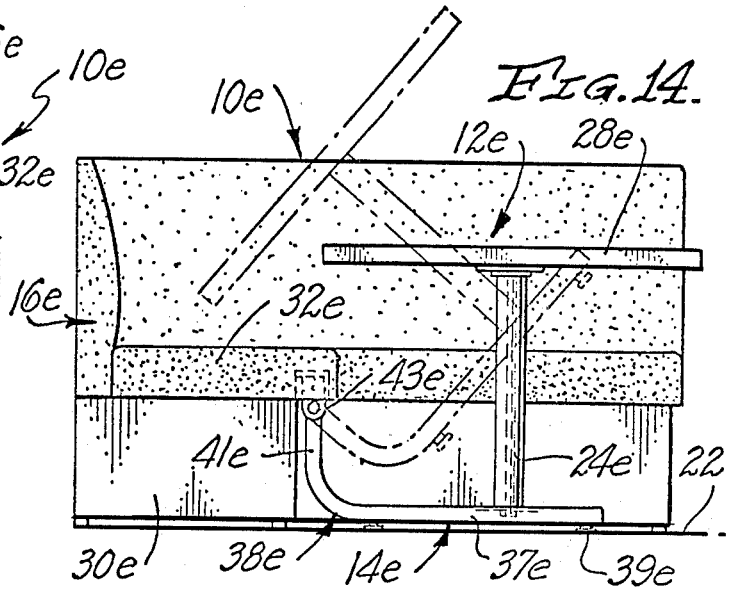
FIG. 14 is a side elevation of the furniture combination in FIG. 13.

The modified furniture combination **10*e* illustrated in FIGS. 13–16 includes a furniture article 12*e*, in this case a tilt table, pivoted on a slot 16*a* for movement between its solid line normal position for use and its broken line elevated cleaning position of FIG. 14. Table 12*e* is pivotally attached to the seat by pivotal mounting means 14*e*. The primary difference between this embodiment and the earlier described embodiments resides in the fact that the table 12*e*** is retained in its elevated position without mechanical latch means by movement of the center of gravity of the table to or past a deadcenter or overcenter position relative to its pivot axis.

Referring in greater detail to the modified embodiment, the table **12*e* has a top 28*e* supported on two base columns 24*e*. Rigidly attached to the lower ends of those columns are normally horizontal ends 37*e* of generally L-shaped arms 38*e*. These horizontal arm ends are perpendicular to the columns 24*e* and mount feet 39*e* at their undersides for resting on the floor 22 to form a supporting base for the table. The opposite normally vertical ends 41*e* of the arms 38*e* turn upwardly and are pivotally attached by hinges 43*e* to the base frame 30*e* of the seat 16*e* just below the projecting front edge of the seat cushion 32*e***.

Figure 15:
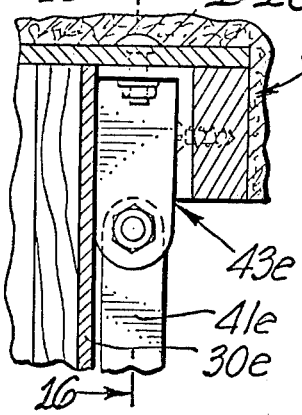
FIG. 15 is an enlarged section through a hinge or pivotal support of the furniture combination in FIGS. 13 and 14.
Figure 16:
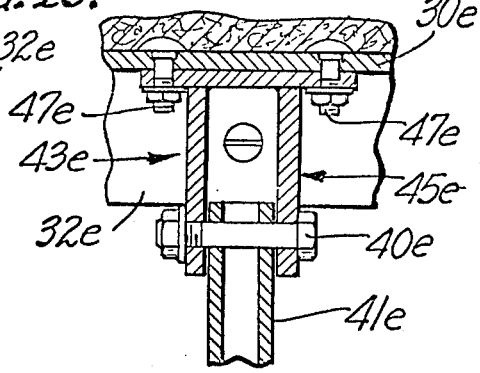
FIG. 16 is a section on line 16—16 in FIG. 15.

Referring to FIGS. 15 and 16, the hinges **43*e***, which are essentially identical, each comprise a hinge bracket 45*e* attached by fasteners 47*e* to the upper front top portion of the seat frame 30*e*. Bracket 43*e* has spaced depending flanges 49*e* which straddle the upper extremity of the adjacent table support arm end 41*e*. Extending through the flanges and arm end is a bolt 40*e* which forms a pivot for the respective table support arm 38*e*. The pivot axes of the two arm hinges 43*d* are aligned.

Figure 17:
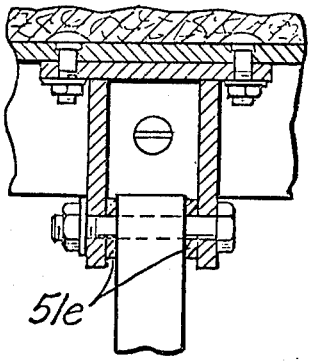
FIG. 17 is an enlarged section through a modified pivotal support or hinge.

In normal use, the table 12*e* occupies its solid line position of FIG. 14, wherein the table support arm ends 37*e* are horizontal and their feet 39*e* rest on the floor 22. The table is elevated to its broken line raised cleaning position of FIG. 14 by rotating the table upwardly and toward the seat 16*e* about the common pivot axis of the hinges 43*e*. According to a feature of this furniture embodiment, when the table is thus elevated, its center of gravity moves to a dead-center position approximately over the hinge axis so that the table is retained in its raised position without the need for mechanical latch means, as required in the earlier described embodiments. In this regard, it is important to note that the hinge bolts 40*e* are tightened to provide sufficient friction between the hinge brackets 45*e* and the support arms 38*e* to retain the table in its raised deadcenter or overcenter position. If necessary, friction washers 51*e* (FIG. 17) may be placed between the hinge bracket flanges 49*e* and the table support arm 38*e*. It is also possible to have the table rotate past deadcenter or overcenter position to a position wherein the arms engage stops on the slot frame 30*e* so that gravity will retain the table in raised position.

Figure 18:
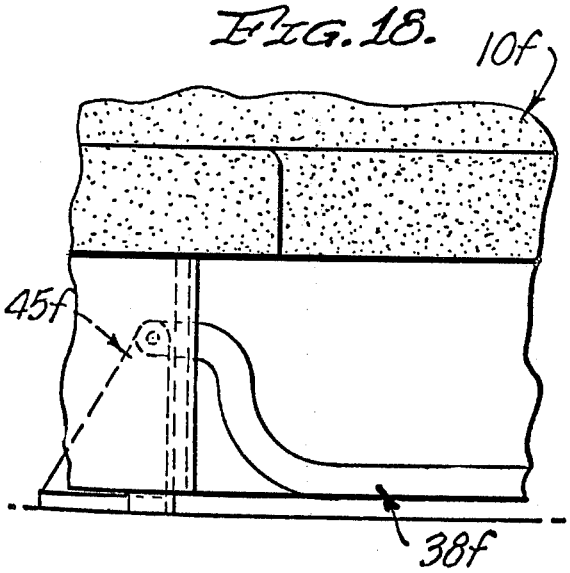
FIG. 18 is a side elevation of a further modified furniture combination similar to that of FIGS. 13 and 14.
Figure 19:
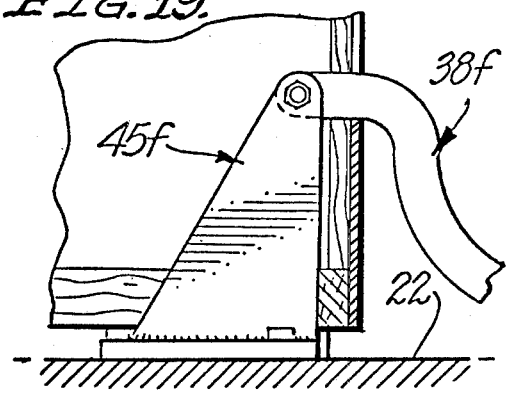
FIG. 19 is a section through the furniture combination of FIG. 18 illustrating a pivotal support or hinge of the combination.

The modified furniture combination 10*f* of FIGS. 18 and 19 is similar to that just described except that the table support arms 38*f* are pivotally attached to hinge brackets 45*f* fastened to the floor 22 rather than to the seat. The table (not shown) is elevated to and retained in its raised position in the same manner as the table in FIGS. 13 and 14.

Turning now to FIGS. 20 – 27, there is illustrated a dining nook 10*g* embodying a modified tilt table 14*g* according to the invention. Nook 10*g* has an L-shaped bench seat 12*g* with seat and back rest cushions 16*g*, 18*g* supported on a base 19*g*. Table 14*g* is located in front of the seat and is hingably supported on the seat base 19*g*, in the manner explained later, for swinging between its full and broken line positions of FIG. 20. The full line position is the normal position of use of the table wherein the latter rests on the floor. The broken line position is an elevated cleaning position of the table, wherein the latter is raised off the floor to permit cleaning below the table.

Table 14*g* has a base 20*g* including two vertical supporting columns 22*g*. Atop the base 20*g* are mounting means 24*g* for a table top 26*g*. According to a feature of the invention, the table top 26*g* is adjustable edgewise relative to the table base 20*g*, and locking means 28*g* are provided for locking the top in adjusted position to enable upward swinging or tilting of the table to and retention of the table in its raised cleaning position. The manner in which the adjustment and locking feature accomplishes this objective will be explained presently. Suffice it to say here that so far as the present invention is concerned, a variety of table top mounting means and locking means may be employed in the present furniture combination. The particular mounting means and locking means illustrated form the subject matter of my earlier mentioned copending application.

These illustrated mounting and locking means will now be described with the understanding that they are illustrative and not limiting in nature.

The table top mounting means 24*g* comprises a horizontal platform 30*g* fixed to the upper ends of the table base columns 22*g*. The underside of the table top 26*g* rests slidably on the platform 30*g*, such that the top is slidably adjustable in all edgewise directions.

Table locking means 28*g* comprises a clamping bar 36*g* extending across the underside and beyond opposite edges of the base platform 30*g*. Below and extending lengthwise of the clamping bar 36*g* is a support bar 37*g* to which the clamping bar is attached at its center by a pivot 38*g*. The ends of the support bar extend beyond the edges of the table base platform 30*g* and are attached to clamp bar ramp brackets 40*g* which are firmly secured to the underside of the table top 26*g* beyond the platform edges. The clamping bar ends extend through the brackets 40*g* and beyond the ends of the support bar 37*g* into recesses 41*g* in a shoulder 43*g* depending from the underside of the table top about the edge. The clamping bar is then pivotally mounted on the table top to swing in a plane parallel to the top and the platform 30*g*.

Referring to FIG. 27, each ramp bracket 40*g* is a generally U-shaped bracket having a horizontal portion, a generally triangular section of which is bent up to form an inclined ramp 42*g*. As noted above, the ends of the clamping bar 36*g* extend through the ramp brackets. These clamping bar ends are slidable back and forth along the bracket ramps 42*g* by swinging movement of the clamping bar about its center pivot 38*g*. Movement of the clamping bar ends toward the high ends of the ramps 42*g* deflects the bar ends upwardly into clamping engagement with the underside of the base platform 30*g* to lock the table top 26*g* in fixed position relative to the platform and hence also the table base 20*g*. Movement of the clamping bar ends to the low ends of the ramps releases the table top for edgewise adjustment relative to the platform. Fixed to the ends of the clamping bar are knobs 46*g* which may be grasped to swing the clamping bar between its clamping and released or top adjustment positions.

From the preceding description, it will be understood that the table top 26*g* may be adjusted in any edgewise direction by releasing the clamping bar 36*g* and then locked into adjusted position by rotating the clamping bar to its clamping position. The bar is accessible at both the rear or inner edge and front or outer edge of the table top for rotation of the bar between its clamping and released positions.

Figure 20:
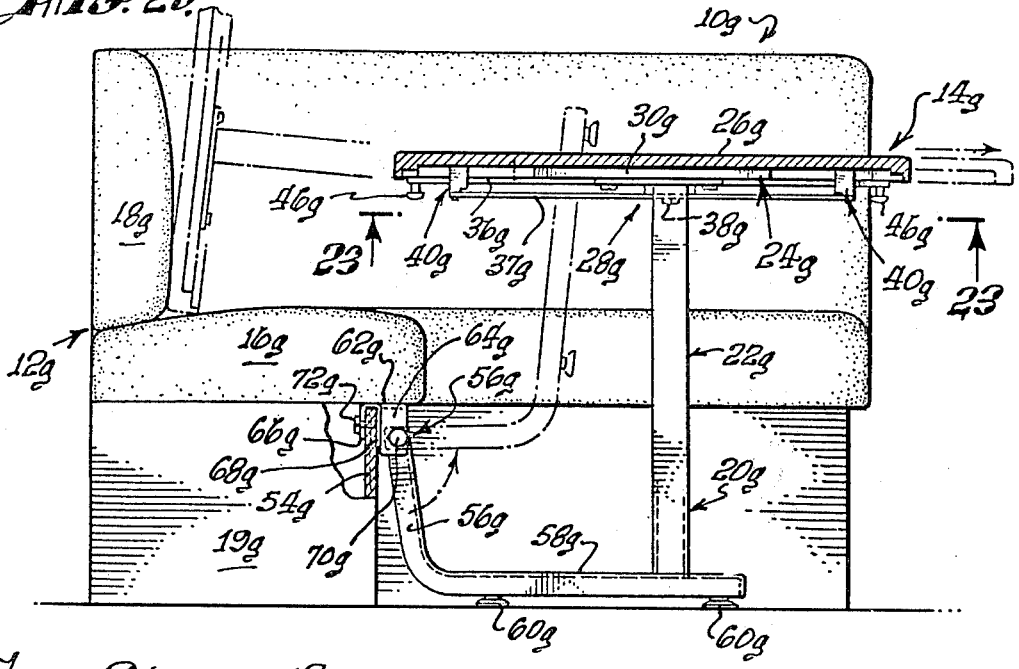
FIG. 20 is a side elevation of a dining nook embodying a further modified adjustable table according to the invention.
Figure 21:
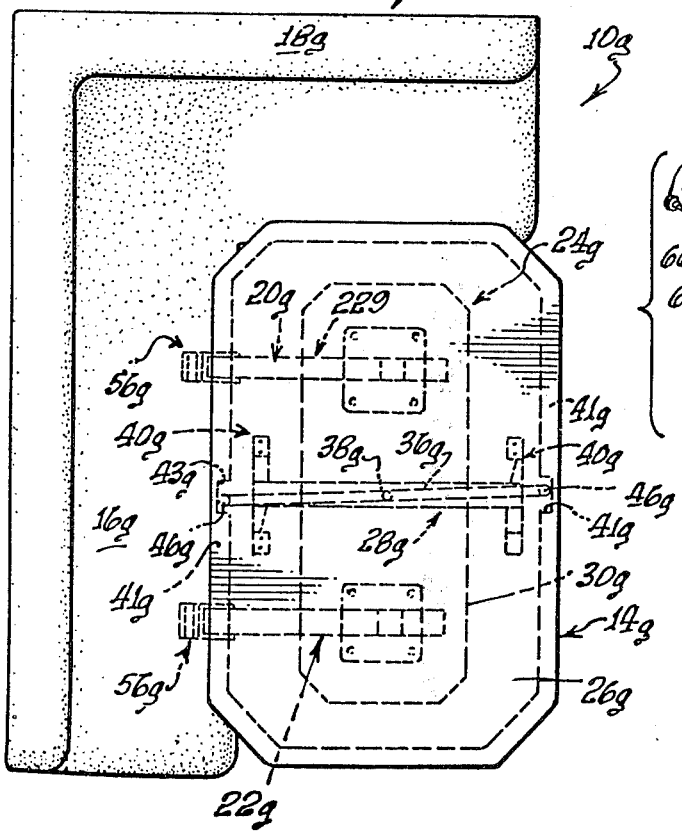
FIG. 21 is a top view of the dining nook in FIG. 20.

As noted earlier, the table 14*g* is hinged to the bench seat 12*g* for swinging vertically between its lower use position and raised cleaning position of FIG. 20. The table is attached to the bench seat base 19*g* by a hinged connection 50*g* including hinge brackets 52*g* which are secured to the front wall 54*g* of the seat base and are pivotally attached to rear upturned ends 56*g* of a pair of generally L-shaped bar-like table base members 58*g* rigidly joined to the lower ends of the table base columns 22*g*. These base members have feet or pads 60*g* which rest on the floor when the table occupies its lower position of use.

Figure 22:
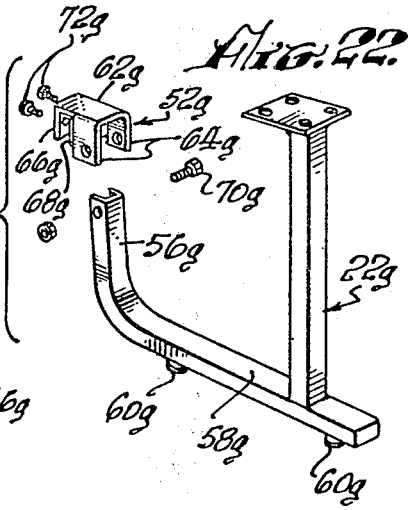
FIG. 22 is an exploded perspective view of a table support embodied in the nook of FIG. 20.

As shown best in FIGS. 20 and 22, each hinge bracket 52*g* has a normally upper plate 62*g* of rectangular shape, a pair of parallel depending flanges 64*g* along opposite edges of the plate adjacent the end thereof, and a depending flange 66*g* along the opposite end of the plate disposed in a plane normal to the planes of the flanges 64*g*. A plate 68*g* is welded or otherwise rigidly joined to the edges of the flanges 64*g* adjacent the flange 66*g*. The bracket flanges 64*g* straddle and are pivotally joined by bolts 70*g* to the rear upper ends of the table base members 58*g*. The brackets 52*g* are placed over the upper edge of the front seat base wall 54*g* with the bracket flanges 66*g* and plates 68*g* straddling the wall and the bracket plates 62*g* resting on the upper wall edge, as shown in FIG. 20. The bracket flanges 66*g* are attached to the wall by screws 72*g*. It will be understood that the upturned rear ends 56*g* of the table base members 58*g* are dimensionted relative to the height of the base wall 54*g* in a manner such that the table base pads 60*g* will rest flat on the floor when the table 14*g* occupies its lower position of use.

From the preceding description and from FIG. 20, it will be seen that the hinge connection 50*g* supports the table 14*g* on the bench seat 12*g* for swinging vertically between its lower use position and raised cleaning position of FIG. 20. As just noted, in the use position, the table base pads 60*g* rest flat on the floor. The table top 26*g* is adjustable edgewise to locate the top in a convenient position relative to both sections of the bench seat and is locked in adjusted position by the clamp bar 36*g*. In the raised cleaning position of the table, the rear edge of the top 26*g* rests on the seat cushion 16*g* of one section of the bench seat 12*g*. When raising the table, the table top is adjusted to and locked in its forward or outer limiting position of adjustment, shown in phantom lines in the upper right-hand portion of FIG. 20. This locates the rear or inner edge of the top well forwardly to clear the backrest cushion 18*g* of the bench seat when raising and lowering the table and also locates the table base 20*g* rearwardly as far as possible in the raised position of the table, such that during upward swinging of the table to the raised position, its center of gravity moves through and well past or rearwardly of the dead center position over the table hinge axis. Accordingly, the table is retained in its raised position by gravity. The table top is locked in its forward position during raising and lowering of the table to prevent the top from sliding back and forth.

The Inventor claims:

1. A furniture combination comprising:

a seat including a generally horizontal seat portion and an upright back rest portion, a table positioned in front of said seat having a supporting base including a pedestal and arm means rigidly attached at one end to the lower end of said pedestal and extending rearwardly toward the end of said seat, and a table top secured to the upper end of said pedestal above the level of said seat portion, and pivot means adjacent the other end of said arm means located below said seat portion but a substantial distance above floor level pivotally mounting said arm on said seat for vertical swinging movement of said table about a pivot axis located above floor level between a lower portion of use wherein said table base rests on the floor and an elevated cleaning position wherein said table base is raised above the floor and said table top is located in an inclined position over said seat portion forwardly of said backrest portion to permit cleaning below the table.

2. A furniture combination according to claim 1 wherein:

said pivot means are located between the ends of said arm means, and retaining means engagable with the other end of said arm means for releasably retaining said table in elevated position.

3. A furniture combination according to claim 2 wherein:

said retaining means comprises yieldable detent means.

4. A furniture combination according to claim 3 wherein:

said arm means comprises an arm, and said detent means comprises a pair of members on said seat straddling said other arm end and between which the latter arm end moves during raising and lowering of said table, a spring urging said members toward one another, and a projecting detent on the inner side of one member which engages said other arm end in the raised position of said furniture article.

5. A furniture combination according to claim 1 wherein:

the center of gravity of said table when in elevated position is located approximately directly over said pivot axis, whereby said table may be balanced in said elevated position.

6. A furniture combination according to claim 1 wherein:

the center of gravity of said table when in elevated position is located approximately over said pivot axis, and said pivot means includes friction means for frictionally retaining said table balanced in said elevated position.

7. A furniture combination according to claim 6 wherein:

said friction means comprises relatively rotatable contacting friction surfaces in said pivot means.

8. A furniture combination according to claim 1 wherein:

the center of gravity of said table when in elevated position is located rearwardly of said pivot axis, whereby gravity retains said table in elevated position.

9. A furniture combination according to claim 8 wherein:

said table top rests on said seat portion when said table is in elevated position.

10. A furniture combination according to claim 9 wherein:

said table includes means for adjusting said table top edgewise rearwardly toward and forwardly away from said seat, and means for releasably locking said top in adjusted position, whereby said table top may be locked in its forward position when raising said table to its elevated position.

11. A furniture combination according to claim 10, wherein:

said arm means has a front portion transverse to said pedestal and a rear portion extending transversely of said front portion and upwardly toward the under side of said seat portion, and said pivot means is located at the upper end of said rear portion of said arm means.

12. A furniture combination according to claim 1, wherein:

said arm means has a front portion transverse to said pedestal and a rear portion extending transversely of said front portion and upwardly toward the under side of said seat portion, and said pivot means is located at the upper end of said rear portion of said arm means.

13. A furniture combination according to claim 12 wherein:

said pivot means include bracket means for attachment to the floor.

14. A furniture combination according to claim 12 wherein:

said pivot means include bracket means attached to the under side of the seat portion.

15. A furniture combination according to claim 12 wherein:

said seat base has a front wall rising to the under side of said seat portion, and said pivot means includes bracket means fitting over the upper edge of and secured to the front base wall.

* * * * *